US006148442A

United States Patent [19]

Porter

[11] Patent Number: 6,148,442

[45] Date of Patent: Nov. 21, 2000

[54] SAFETY WORK-CLOTHING

[76] Inventor: A. Lee Porter, Mr. A. Lee Porter P.O. Box 241, Cadogan, Pa. 16212

[21] Appl. No.: 08/995,404

[22] Filed: Dec. 29, 1997

Related U.S. Application Data

[60] Provisional application No. 60/035,642, Jan. 17, 1997.

[51] Int. Cl.[7] ..... A41B 1/00

[52] U.S. Cl. ..... 2/69; 2/115; 2/227

[58] Field of Search ..... 2/69, 108, 102, 2/94, 93, 85, 95, 115, 227, 228, 79, 244, 246, 243.1, 1, 113

[56] References Cited

U.S. PATENT DOCUMENTS

| | | | |
|---|---|---|---|
| 3,837,007 | 9/1974 | Girest . | |
| 4,365,354 | 12/1982 | Sullivan . | |
| 4,815,146 | 3/1989 | Theewis et al. | 2/94 |
| 4,817,210 | 4/1989 | Aldridge et al. | 2/93 X |
| 5,159,718 | 11/1992 | Moyer | 2/69 |
| 5,193,026 | 3/1993 | Purvis . | |
| 5,588,154 | 12/1996 | Blauer . | |
| 5,588,156 | 12/1996 | Panton, Jr. | 2/244 X |

OTHER PUBLICATIONS

Mail Runner's Catalog, p. 13, item A; Oct. 12, 1984.

*Primary Examiner*—Gloria M. Hale

*Attorney, Agent, or Firm*—Jones, Tullar & Cooper, P.C.; Daniel A. Sullivan Jr.

[57] ABSTRACT

The present invention provides reflectorized and/or safety-colored work clothes. A reflectorized tee shirt is included, which may be a member of a layered set of safety clothing. Use of the clothing system of the invention avoids the problem of taking off a layer of clothing by first removing a safety vest, then removing, for instance, coveralls, then putting vest back on. In the invention, for example, as reflective coveralls are removed, then beneath is a reflective tee shirt, ready to provide continued safety visibility.

7 Claims, 3 Drawing Sheets

SAFETY WORK-CLOTHING

CROSS-REFERENCE TO RELATED APPLICATION

The benefit of provisional application No. 60/035,642 filed Jan. 17, 1997 is claimed is incorporated here by reference.

TECHNICAL FIELD

The present invention relates to safety clothing for work in general, and particularly for tree servicing, for example tree cutting, trimming, or logging.

BACKGROUND OF INVENTION

OSHA Regulation 29 CFR 1926.201(a)(4) states, "Flagmen shall be provided with and shall wear a red or orange warning garment while flagging. Warning garments worn at night shall be of reflectorized material." Pennsylvania Department of Transportation Publication No. 203, Section 203.122(b)(2) contains similar specifications.

A known way of meeting these regulations and, in general, of meeting the need to provide any workers around traffic with increased visibility is through the use of reflectorized vests. An example of such vests is shown in FIG. 1. Vest 10 is formed basically of a plastic, orange-colored, mesh material 12. The cut edges of mesh material 12 are enclosed by a binding material 14, which can be of cloth or plastic tape. The two front panels 16*a* and *b* are held in place relative to the back panel 18 by elastic bands 20*a* and *b*. Two reflectorized, or retroreflective, strips 22*a* and *b* are sewn in place vertically on the outside of the front panels, over the shoulder, and down the outside of the back panel. As viewed in FIG. 1, the strips 22*a* and *b* on the back panel are behind the mesh material 12, and this has been indicated by showing the mesh texture superimposed on the strips at the bottom of the drawing. Interlocking fiber fabric straps 24*a* and *b*, such as VELCRO straps manufactured by Velcro USA, Inc., of Manchester, N.H., provide for the joining of the front panels together.

I have determined that safety vests like that shown in FIG. 1 have a number of disadvantages, including the following:

1. The current vest is uncomfortable to wear. For instance, particularly in tree cutting, the binding, if cloth, will pill and fray as it wears, due to scraping against bark and brush, or, if plastic, it even cracks. This leads to its rubbing against the back of your neck, causing a dangerous distraction from the job you are performing, for instance operating a chain saw.

2. The current vest can easily be lost by an employee, causing the company additional expenses in replacement.

3. The employee can simply choose not to wear the current vest.

4. The current vests can even be the cause of serious accidents. They snag as one walks through brush or other protruding obstacles, and can get caught in moving equipment or tools, as they fit loose on the body. They have added problems with elastic bands or ties and Velcro connectors. For instance, any of these can also snag and tear loose, enabling the vest to billow up in the wind and get in the line of vision.

5. The current vests are hot in warm weather, even though many of them are a mesh material. The plastic material forming the mesh becomes stiff and hard in cold weather.

6. The reflectorized strips tend to fall off the vest, because the mesh material of the vest will not hold the thread.

7. Constantly replacing these vests is a major expense to companies.

DISCLOSURE OF INVENTION

An object of the invention is to provide improved safety work-clothing.

Another object of the invention is to provide a safety work-clothing system.

Other objects of the invention will become apparent from the remainder of this specification as set forth below.

Toward accomplishing one or more of these objects, the present invention departs from the standard safety vest and, instead, provides reflectorization of the work clothes themselves. Besides bearing, for example, retroreflective strips to provide the reflectorization, the clothes may have, as well, a safety color, such as orange or red. Fluorescent orange material is an example of a suitable material.

Examples of work clothes of the invention are a comfortable, cotton-type tee shirt or sweatshirt, as well as work pants, or coveralls. These reflectorized and/or safety-colored clothes are worn as regular part of the daily work clothing and are, consequently, always on. The safety work-clothes of the invention become part of an employee's daily dressing. The terms "work clothes" and "work clothing" as used herein do not encompass the above-referenced safety vests, or uniforms, such as in U.S. Pat. Nos. 3,837,007 and 5,588,154, or the gear worn by fire personnel, but, instead, are meant to refer to the attire worn by trades-people and laborers, i.e. that group of clothing, which, in the past, was covered by the safety vest, when greater visibility was required.

Because the reflectorization is on the work clothes themselves, the clothing may fit closely to the body, where such is an important factor for safety reasons. The clothing of the invention is more comfortable, and, by eliminating the vest, is one less article of clothing to wear. There is no special need for Velcro fasteners, elastic bands, or ties to rip or snag.

Clothing of the invention may be constructed of washable, breathable material, such as cotton. It is much more durable than the vest and less likely to rip. Advantageously, the reflecting and/or fluorescent material is provided as bands on the cotton, the bands being narrow compared to the width of the clothing, so that the bands do not significantly impare the breathing character of the cotton, should the bands be made of a less breathable character than the cotton. Thus, the clothing is preferably essentially of cotton, but small amounts of other materials, such as these bands, may also be present.

The safety work-clothing of the invention may be used as a clothing system, incorporating the principle of clothes-layering. A reflectorized tee shirt may be the basic under-shirt. Then, when it gets colder, you put on reflectorized coveralls. When strenuous exertion or warming of the day causes you to heat up, just remove the coveralls, and the tee shirt of the invention is instantly exposed, ready to perform its safety function. The idea is "layering", all layers being reflectorized and/or safety-colored.

Use of the clothing system of the invention avoids the problem of taking off a layer of clothing by first removing vest, then removing coveralls, then putting vest back on. In the invention, you strip-off reflective coveralls, and then beneath is the reflective tee shirt. You are quickly ready to continue working.

For summer work, the safety work-clothing of the invention is cooler. Only one shirt needs to be worn—i.e., the reflectorized tee shirt of the invention—rather than in the prior art situation, where two things would be worn—tee shirt plus vest.

MODES OF THE INVENTION

Figure 2:
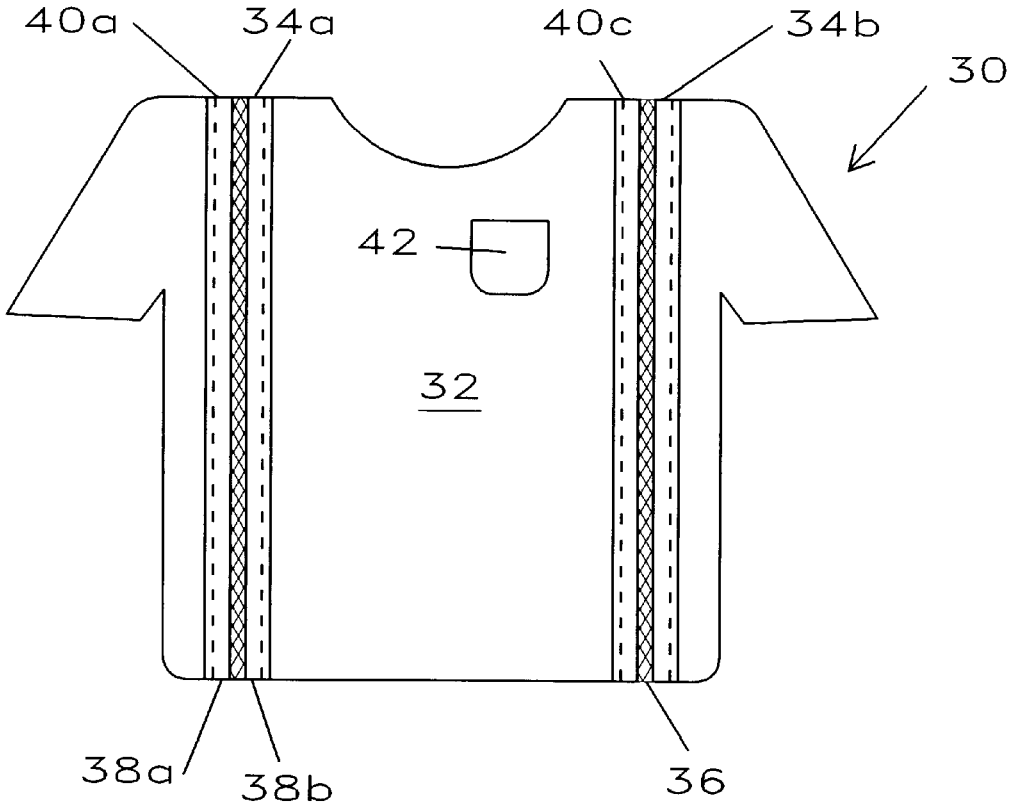
FIGS. 2 and 3 are, respectively, front and rear views of a tee shirt of the invention.
Figure 3:
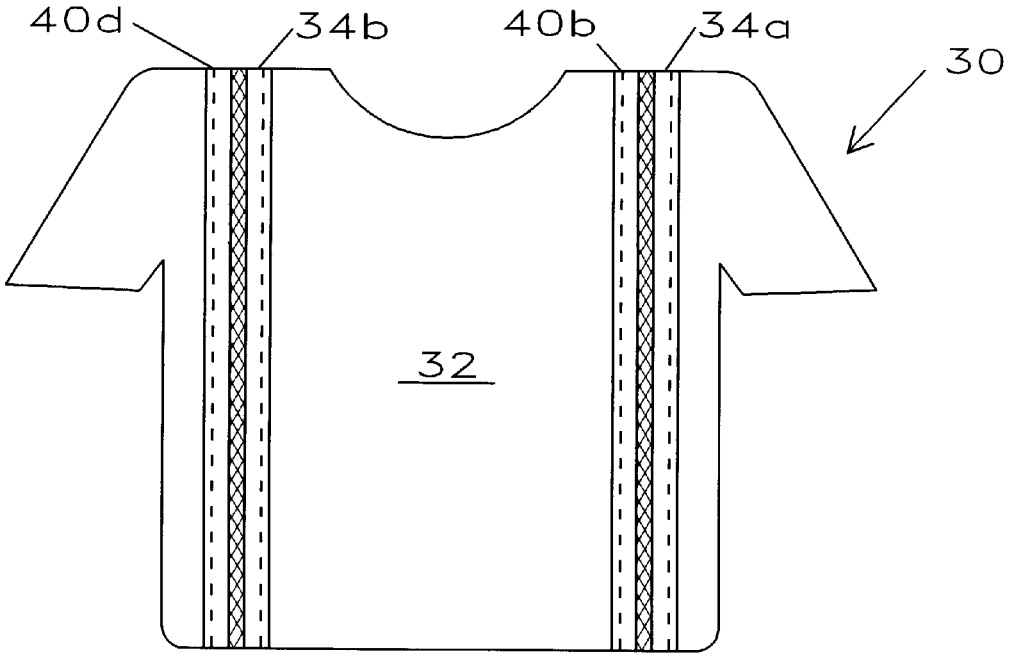

FIGS. 2 and 3 illustrate a preferred embodiment of a clothing article of the invention. Tee shirt 30 is constructed of a cotton knit material 32. Material 32 has been dyed orange, a safety color. The cotton has the characteristic of wicking moisture, which adds to the comfort of the material in hot summer use.

Two bands 34*a* and *b* of reflective vest trim are sewn vertically on the front, over the shoulder, and on the rear of the tee shirt, on the torso portion of the shirt. The vertical orientation of the bands is advantageous for tree cutters, because the bands tend not to catch on protrusions, as is the situation in the case of horizontal bands, in climbing or descending. An example of a suitable trim may be about two inches wide and includes a ⅝-inch wide, central, silver reflective, or retroreflective, stripe, reflectorized region 36, bounded laterally by two fluorescent regions 38*a* and *b*. The center stripe is especially effective for nighttime visibility, while the fluorescent regions increase daytime visibility.

Suitable examples of this trim are available from 3M Company, St. Paul, Minn., as Scotchlite Reflective Vest Trim, No. 8471 Fluorescent Lime-Yellow with Silver Reflective Stripe, and No. 8472 Fluorescent Red-Orange with Silver Reflective Stripe. The silver stripes have a coefficient of retroreflection, as measured by retroreflective intensity testing procedures ASTM E809 and E810, of 500 candelas/lux/square meter typical at −4 deg. entrance angle, 0.2 deg. observation angle. Reflected color is white. The lime-yellow borders of No. 8471 are preferred for use with an orange colored tee shirt, for increased visual safety effect.

Four rows of stitching 40*a* to *d*, which may be double or triple stitching, holds the two bands of trim in place on the tee shirt. It is preferred to use a lockstitch with no more than 12 stitches per inch, placed at least 2 mm from the edge of the trim. Besides stitching, other suitable modes of attachment are bonding, or gluing, of the bands to the tee shirt. Attachment with Velcro fasteners is not desirable, since snagging on brush can be sufficient to break such attachments loose.

Figure 1:
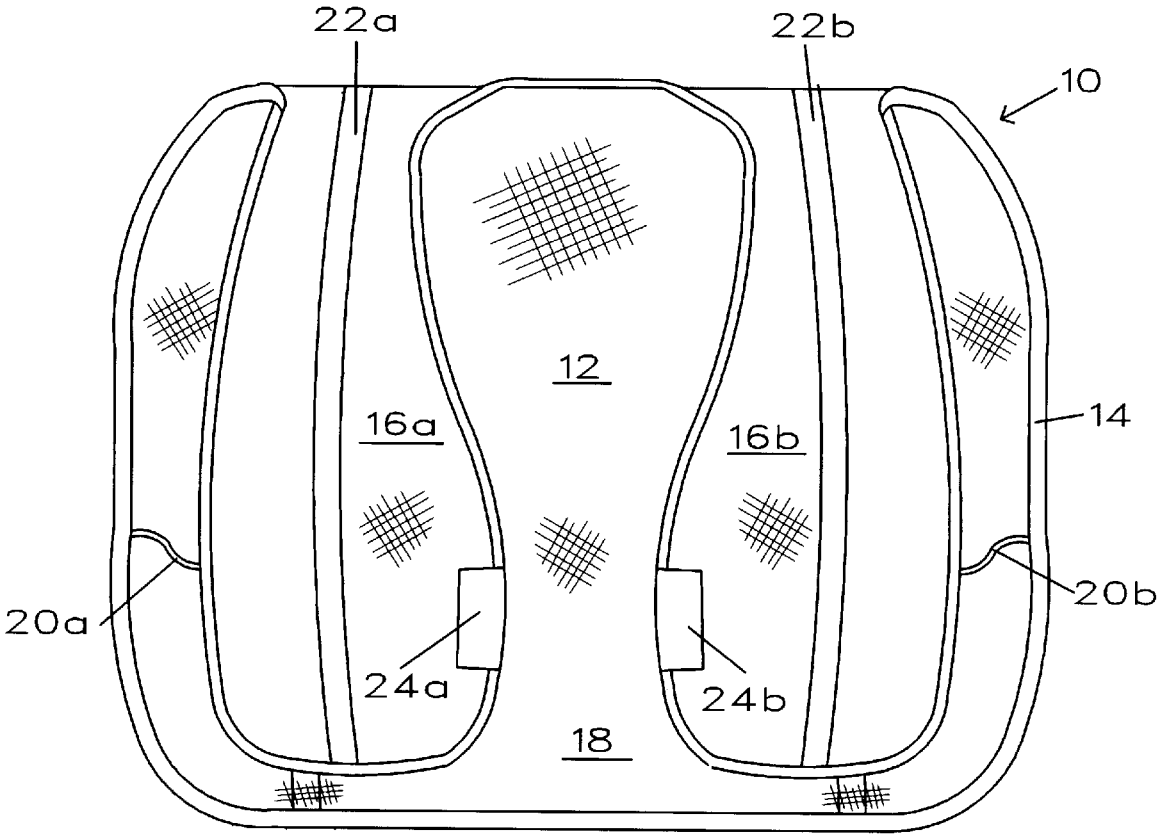
FIG.1 (PRIOR ART)
FIG. 1 is a front view of a prior-art safety work-vest, which is described in detail above, in the section BACKGROUND OF INVENTION.

The tee shirt also bears a pocket 42. Unlike the vest of FIG. 1, the tee shirt has a snugly fitting, tubular construction, which cannot be torn open, as happens with the elastic bands, ties, and Velcro fasteners of vests.

The tee shirt of FIGS. 2 and 3 can be the foundation garment in a set of clothing fitting a given individual. Each piece of clothing is progressively larger, or capable of stretching to be larger, than the piece beneath, so that the set can be worn in layers, and donned or removed, depending on weather conditions. A pair of coveralls is an example of a piece of clothing which can be worn over the tee shirt in the set of clothing comprising tee shirt and coveralls. Each piece of the clothing in the set is reflectorized and/or safety-colored, so that whatever layer happens to be external at any given time is effective for increasing the visibility of the worker to the traffic.

Figure 4:
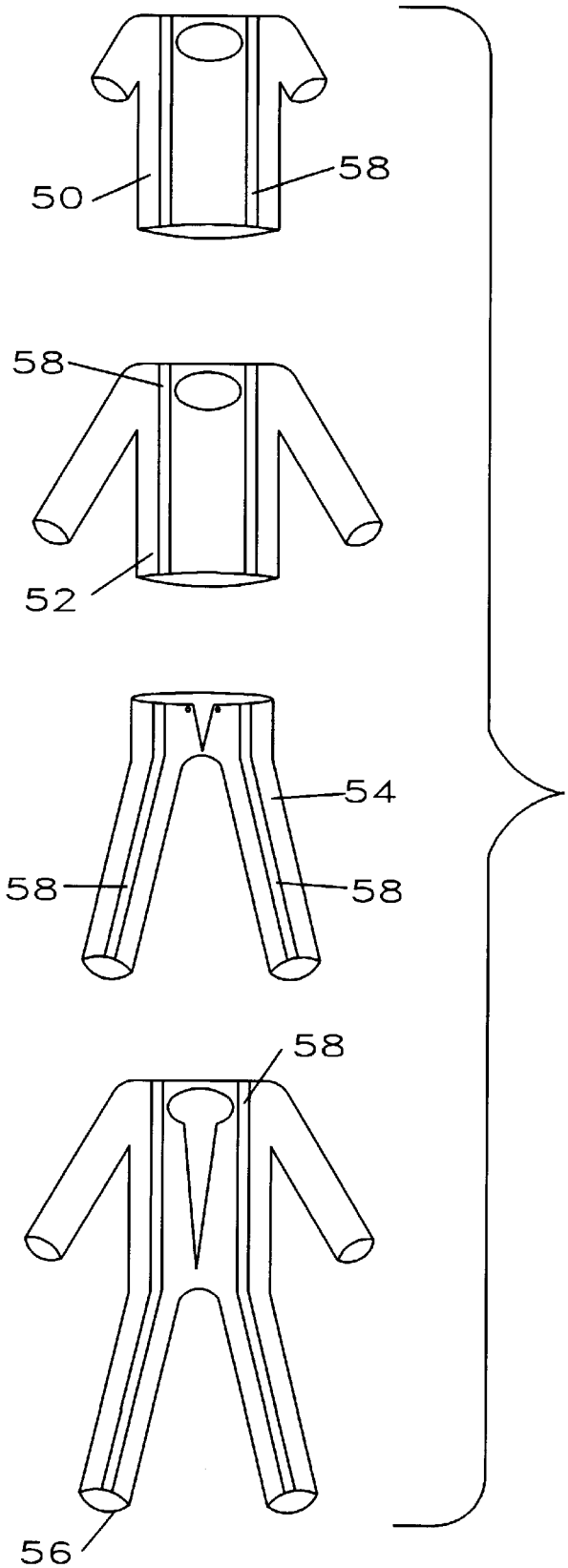
FIG. 4 shows, in exploded view, a layered set of clothing of the invention.

FIG. 4 illustrates an example of such a layered set of clothing of the invention. The front and back sides of tee shirt 50, sweatshirt 52, pants 54 and coveralls 56 are provided with reflective vest trim 58 sewn in place. Similarly, vertically oriented reflective vest trim, not shown, is also sewn on laterally exposed surfaces of each of these articles of clothing, to increase lateral visibility. The members of this set of clothing are sized such that the outer garments fit over the inner garments. The tee shirt and pants of the set are worn closest to the body. The sweat shirt fits over the tee shirt, and the coveralls fits over the sweatshirt and over the pants. It will be noted here that the term "layered" is used in the sense that an outer garment is essentially completely over an inner garment, as contrasted with any overlap which might occur as a result of a shirt, for instance, being tucked within, or extending over, the waist area of a pair of pants. Thus, in FIG. 4, the sweatshirt will be worn in a layered relationship with the tee shirt, and the coveralls will be worn in a layered relationship with both of those garments, plus the pants.

There follows, now, the claims. It is to be understood that the above are merely preferred modes of carrying-out the invention and that various changes and alterations can be made without departing from the spirit and broader aspects of the invention as defined by the claims set forth below and by the range of equivalency allowed by law.

What is claimed is:

1. A safety garment system comprising, in combination, an outer reflectorized garment having reflectorized trim attached on a front and a rear surface thereof;

an inner relectorized garment having reflectorized trim attached on a front and a rear surface thereof;

said inner and outer garments constructed to be worn as a layered set with said inner garment worn under said outer garment; and when said outer garment is removed said inner garment has the reflective trim in locations giving the wearer a protection and appearance with the reflectorized trim as when said outer garment is worn over said inner garment.

2. A system as claimed in claim 1, in which the trims are attached vertically on both garments.

3. A system as claimed in claim 2, in which, when said inner garment is worn inside said outer garment, said reflectorized trim is in the same location on a wearer; and when said outer garment is removed said inner garment has the same reflective trim in said same locations giving the wearer the same protection and appearance with the reflectorized trim as when said outer garment is worn over said inner garment.

4. A system as claimed in claim 3, in which the garments have upper torso portions with trims attached on shoulder surfaces thereof.

5. A method of using a safety garment system as claimed in claim 1, comprising putting on and removing the outer garment, while keeping the inner garment in place for safety.

6. A tee shirt comprising front, shoulder and rear made of cotton and two bands (34*a* and *b*) of reflective vest trim attached by stitching, bonding or gluing vertically on the front, over the shoulder, and on the rear.

7. A method of using a tee shirt as claimed in claim 6, comprising wearing the tee shirt while tree servicing.

* * * * *